US009400087B2

(12) United States Patent
Marquardt et al.

(10) Patent No.: US 9,400,087 B2
(45) Date of Patent: Jul. 26, 2016

(54) EXTERNALLY MOUNTED SHIELD FOR LED LUMINAIRE

(71) Applicant: ABL IP Holding LLC, Conyers, GA (US)

(72) Inventors: Craig Eugene Marquardt, Covington, GA (US); Patrick A. Collins, Conyers, GA (US); Jie Chen, Snellville, GA (US)

(73) Assignee: ABL IP Holding LLC, Decatur, GA (US)

( * ) Notice: Subject to any disclaimer, the term of this patent is extended or adjusted under 35 U.S.C. 154(b) by 67 days.

(21) Appl. No.: 14/206,424

(22) Filed: Mar. 12, 2014

(65) Prior Publication Data

US 2014/0313718 A1 Oct. 23, 2014

Related U.S. Application Data

(60) Provisional application No. 61/777,270, filed on Mar. 12, 2013.

(51) Int. Cl.

| | |
|---|---|
| ***F21V 1/00*** | (2006.01) |
| ***F21V 11/00*** | (2015.01) |
| ***F21K 99/00*** | (2016.01) |
| ***F21V 7/00*** | (2006.01) |
| ***F21V 11/16*** | (2006.01) |
| *F21S 8/08* | (2006.01) |

(52) U.S. Cl.

CPC ... *F21K 9/30* (2013.01); *F21K 9/52* (2013.01); *F21V 7/0066* (2013.01); *F21V 7/0083* (2013.01); *F21V 11/16* (2013.01); *F21S 8/086* (2013.01)

(58) Field of Classification Search

CPC ..... F21K 9/30; F21K 9/50; F21S 8/086; F21V 7/0008; F21V 7/0041; F21V 7/0066; F21V 7/0083; F21V 11/16; F21V 17/06

See application file for complete search history.

(56) References Cited

U.S. PATENT DOCUMENTS

| | | | | |
|---|---|---|---|---|
| 7,086,754 | B2 | 8/2006 | Mooney | |
| 7,637,630 | B2 | 12/2009 | Wilcox et al. | |
| 7,654,691 | B2 | 2/2010 | Liu et al. | |
| 7,794,117 | B2 | 9/2010 | Cheng et al. | |
| 8,002,428 | B2 | 8/2011 | Boyer et al. | |
| 8,007,127 | B2 | 8/2011 | Kim et al. | |
| 8,070,317 | B2 | 12/2011 | Zhang et al. | |
| 8,092,042 | B2 | 1/2012 | Wilcox | |
| 2004/0174706 | A1* | 9/2004 | Kan | 362/241 |
| 2009/0103288 | A1* | 4/2009 | Boyer et al. | 362/153.1 |

(Continued)

*Primary Examiner* — Peggy Neils
*Assistant Examiner* — Alexander Garlen
(74) *Attorney, Agent, or Firm* — Kilpatrick Townsend & Stockton, LLP

(57) ABSTRACT

A shield for a light emitting diode (LED) luminaire includes a frame mountable to the LED luminaire such that the shield is removable therefrom. A plurality of rows of shield surfaces contact the frame and have a first side that faces a row of LEDs located on the LED luminaire and an opposite second side. The first side has a fully or partially reflective surface. The plurality of rows of shield surfaces prevent light from the LEDs from reflecting toward the back of the LED luminaire. The shield may include notches for allowing removal of one or more of the plurality of rows of shield surfaces or a portion thereof from the frame and for customization of light distribution from the LED luminaire. The shield may also be cut lengthwise such that each of the plurality of rows of shield surfaces includes a partial shield surface and shields only a portion of a row of LEDs located on the LED luminaire.

16 Claims, 11 Drawing Sheets

(56) References Cited

U.S. PATENT DOCUMENTS

| | | | | |
|---|---|---|---|---|
| 2009/0225543 | A1 | 9/2009 | Jacobson et al. | |
| 2009/0262532 | A1* | 10/2009 | Wilcox et al. | 362/248 |
| 2009/0323330 | A1* | 12/2009 | Gordin et al. | 362/235 |
| 2010/0110671 | A1 | 5/2010 | Gordin et al. | |
| 2010/0195333 | A1 | 8/2010 | Schaefer et al. | |
| 2011/0032697 | A1 | 2/2011 | Hu et al. | |
| 2011/0038154 | A1 | 2/2011 | Chakravarty et al. | |
| 2011/0051413 | A1 | 3/2011 | Hand | |
| 2011/0194281 | A1 | 8/2011 | Josefowicz et al. | |
| 2011/0242807 | A1 | 10/2011 | Little, Jr. et al. | |
| 2011/0280014 | A1 | 11/2011 | Householder et al. | |
| 2011/0292658 | A1 | 12/2011 | Ho | |
| 2012/0008320 | A1* | 1/2012 | Tu et al. | 362/235 |
| 2012/0026737 | A1 | 2/2012 | Dinc et al. | |
| 2012/0063125 | A1 | 3/2012 | Quaal et al. | |
| 2012/0162977 | A1 | 6/2012 | Chen et al. | |
| 2013/0021798 | A1* | 1/2013 | Chen et al. | 362/244 |
| 2013/0155673 | A1* | 6/2013 | Wang et al. | 362/235 |
| 2014/0063802 | A1* | 3/2014 | Garcia | 362/241 |

* cited by examiner

EXTERNALLY MOUNTED SHIELD FOR LED LUMINAIRE

RELATED APPLICATION

The present application claims the benefit of U.S. Provisional Application Ser. No. 61/777,270, filed Mar. 12, 2013, the disclosure of which is incorporated by this reference in its entirety.

FIELD OF THE INVENTION

The present invention generally relates to shielding for luminaires, and more particularly to externally mounted shielding for light emitting diode luminaires.

BACKGROUND

Light emitting diode ("LED") luminaires, such as Type 5 LED light engines used in roadway luminaires, typically include a series of LEDs arranged in rows, with each LED protected by an optic designed to provide a particular light distribution profile. As shown in FIG. 1, traditional light emitting diode ("LED") luminaires may not include a cover or shield optic, allowing LED light to exit the optic backwards (or in an undesirable direction).

Other traditional designs (not shown) may include shielding features that are integral with the luminaire design, but these designs do not allow the profile of the light exiting the luminaire to be customized.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Removable shields for LED luminaires, and LED luminaires containing the removable shields, are described herein.

BRIEF DESCRIPTION OF THE DRAWINGS

Illustrative embodiments of the present invention are described in detail below with reference to the following drawing figures.

DETAILED DESCRIPTION

Figure 1:
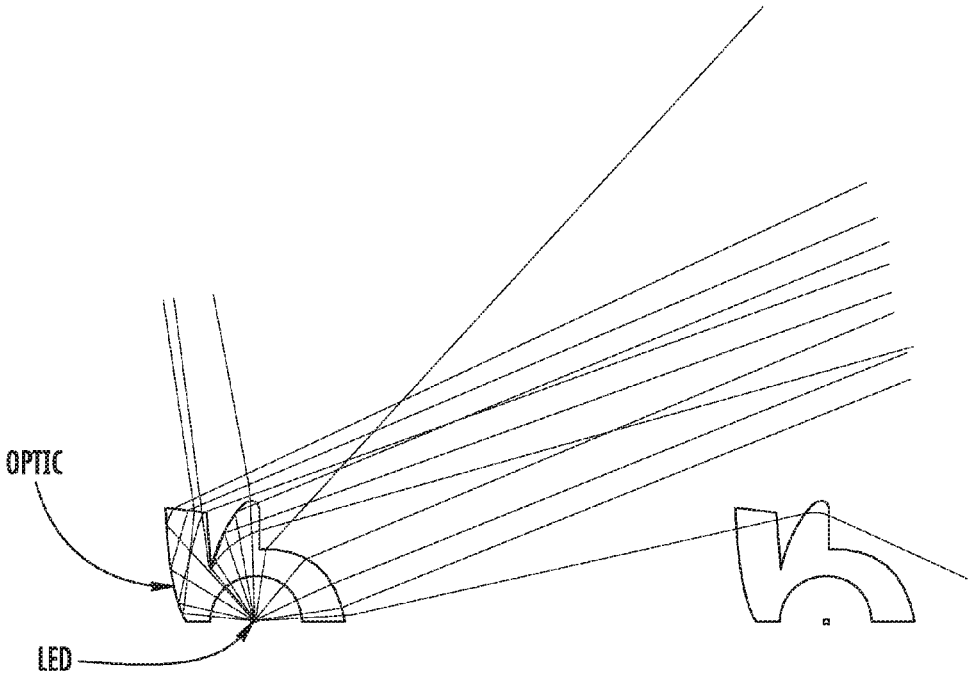
FIG. 1 (PRIOR ART)
FIG. 1 is a side view of a prior art LED optic configuration.
Figure 2:
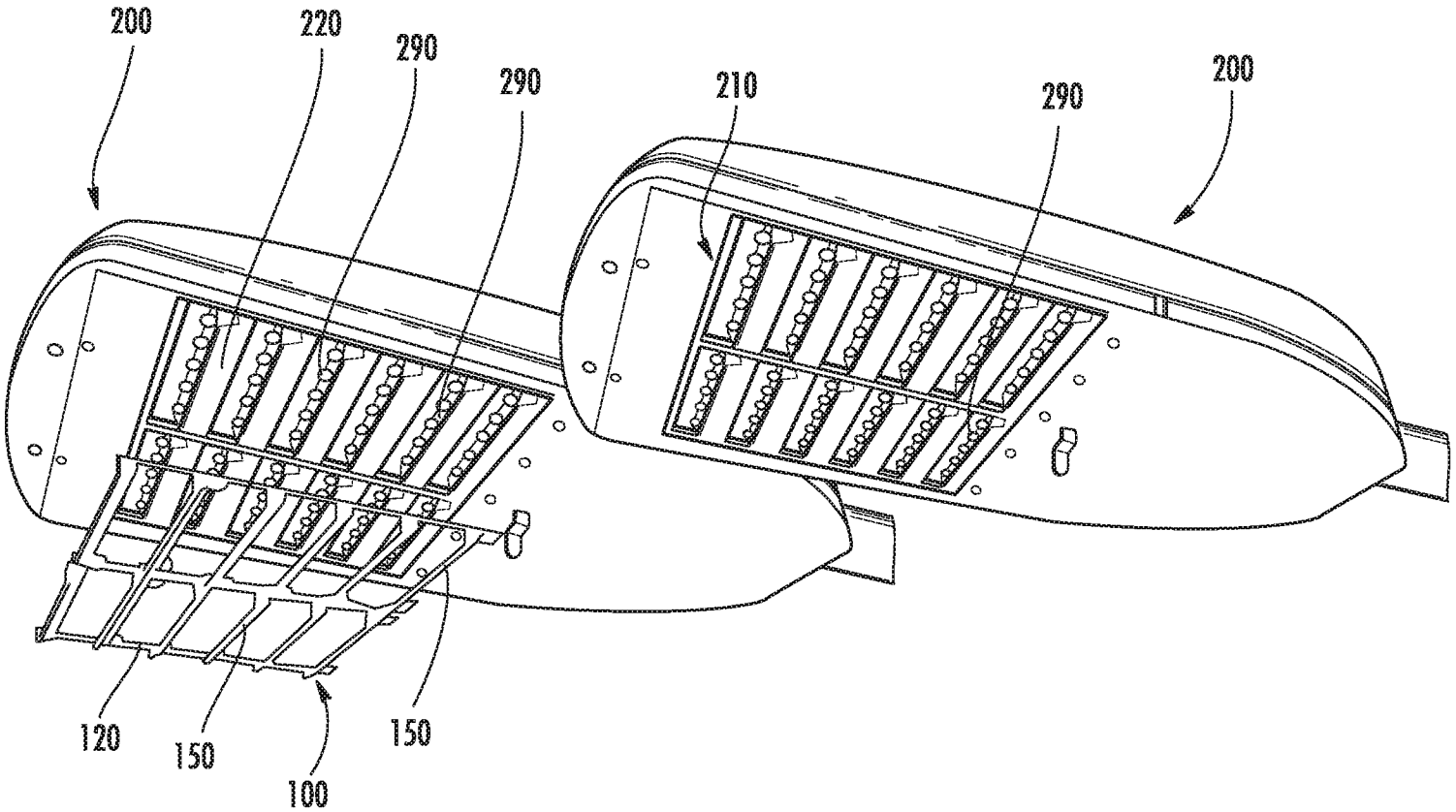
FIG. 2 is a bottom perspective view of an LED luminaire and shield according to an embodiment of the invention.
Figure 3:
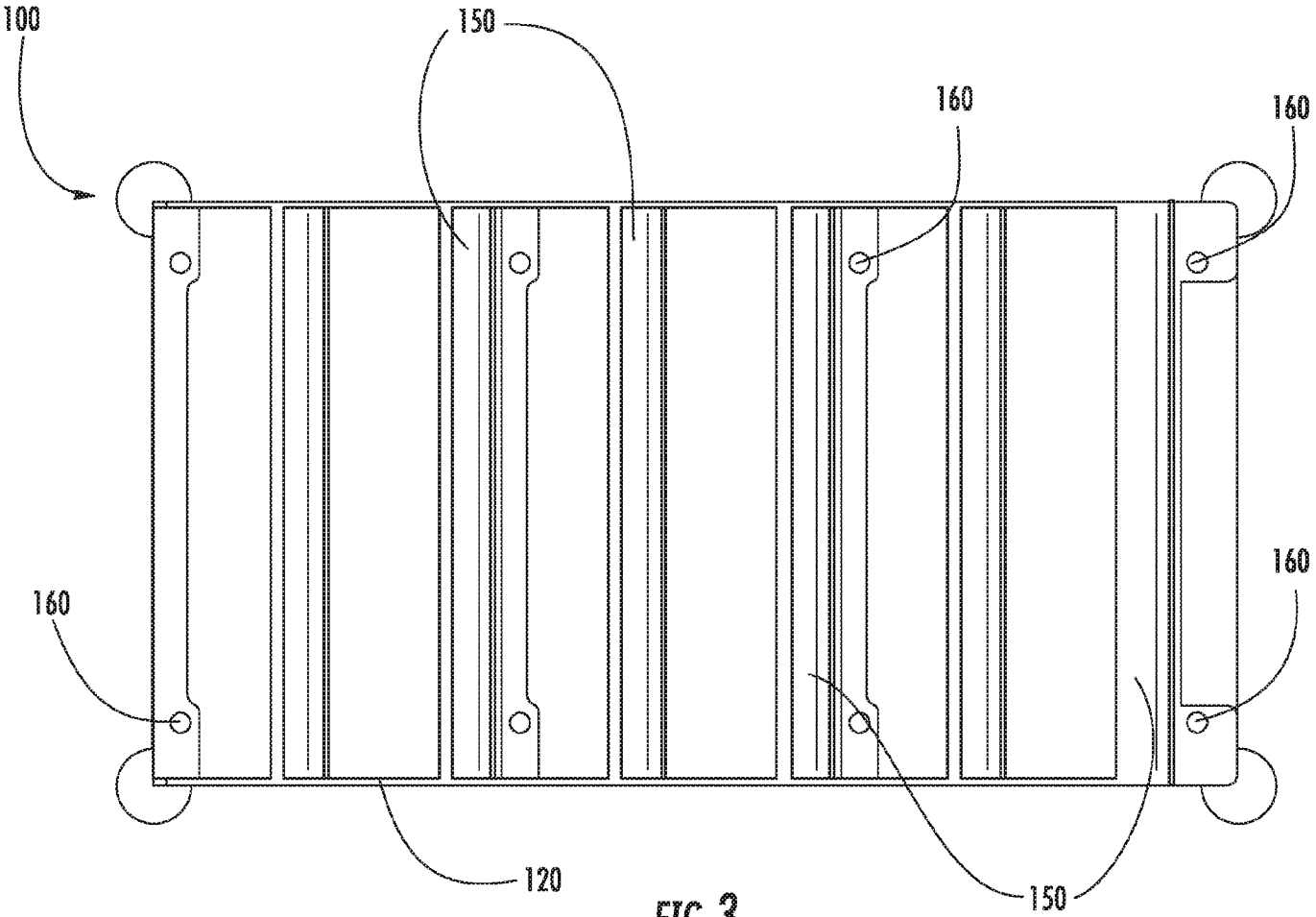
FIG. 3 is a top view of the shield of FIG. 2.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In some embodiments of the invention, various views of which are shown in FIGS. 2-5, a shield 100 for a light emitting diode (LED) luminaire 200 includes a frame 120 mountable to the LED luminaire 200 such that the shield 100 is removable therefrom.

The frame 120 includes a plurality of rows of shield surfaces 150 contacting the frame 120. The rows of shield surfaces 150 may be integrally formed with the frame 120, such as molded with the frame 120, or may be formed separately from the frame 120 and attached to the frame by, e.g., an adhesive or other known fastening means.

Each of the plurality of rows of shield surfaces 150 includes a first side 130 facing a row 290 of LEDs 300 located on the LED luminaire 200 and an opposite second side 140. Each LED 300 may be covered or protected by an optic 310, which can be any suitable type of optic (e.g., single cavity, dual cavity, etc.).

Figure 6:
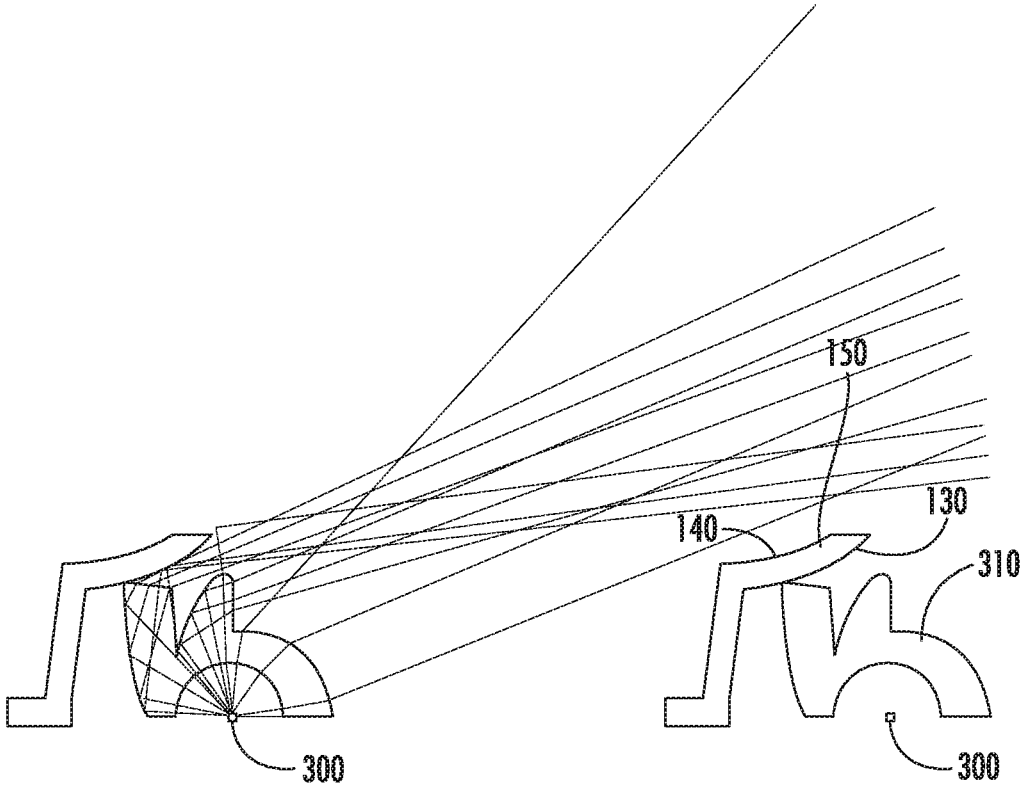
FIG. 6 is a side view of a shield according to an embodiment of the invention showing a light distribution profile.
Figure 7:
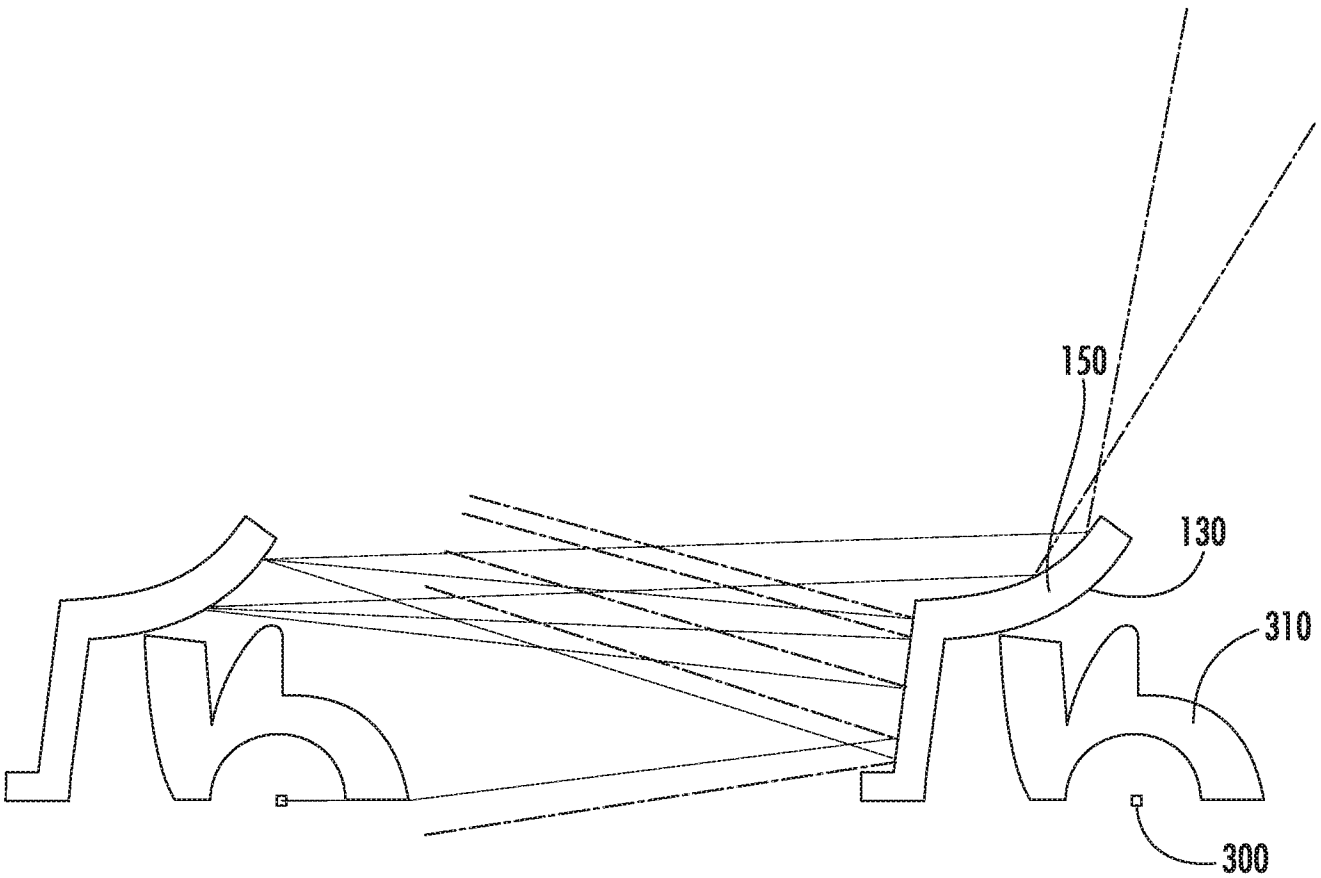
FIG. 7 is a side view of a shield according to an embodiment of the invention showing another light distribution profile.

In certain embodiments, the first side 130 of each of the plurality of rows of shield surfaces 150 has a fully or partially reflective surface so that light that hits it will be reflected forward of the optic 310 (see, e.g., FIGS. 6 and 7). In some embodiments, the opposite second side 140 of each of the plurality of shield surfaces 150 (i.e., the surface facing away from the optic 310) has a diffuse or nonreflective surface so that light from an adjacent optic 310 that hits this surface will not be reflected backward in the undesirable direction. See FIGS. 6 and 7 (the dotted lines in FIG. 7 indicate that light is not reflected). Reflective and diffuse or nonreflective materials for use as coatings on the shield or as the shield material itself (i.e., integrally formed) are known and within the scope of this invention. In some embodiments, light will be reflected 90 degrees forward, but the plurality of shield surfaces 150 will prevent light from being reflected 90 degrees backward.

Figure 4:
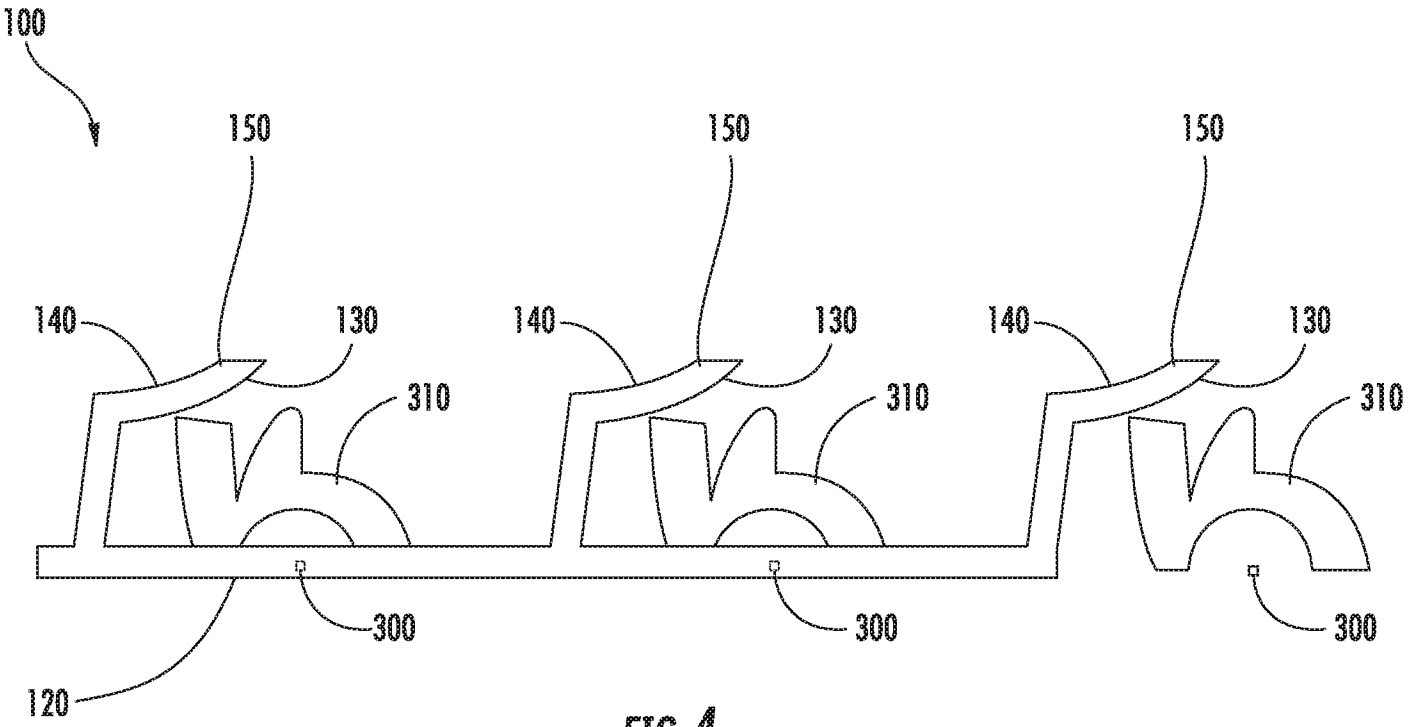
FIG. 4 is a side view of a portion of the shield of FIG. 3.
Figure 5:
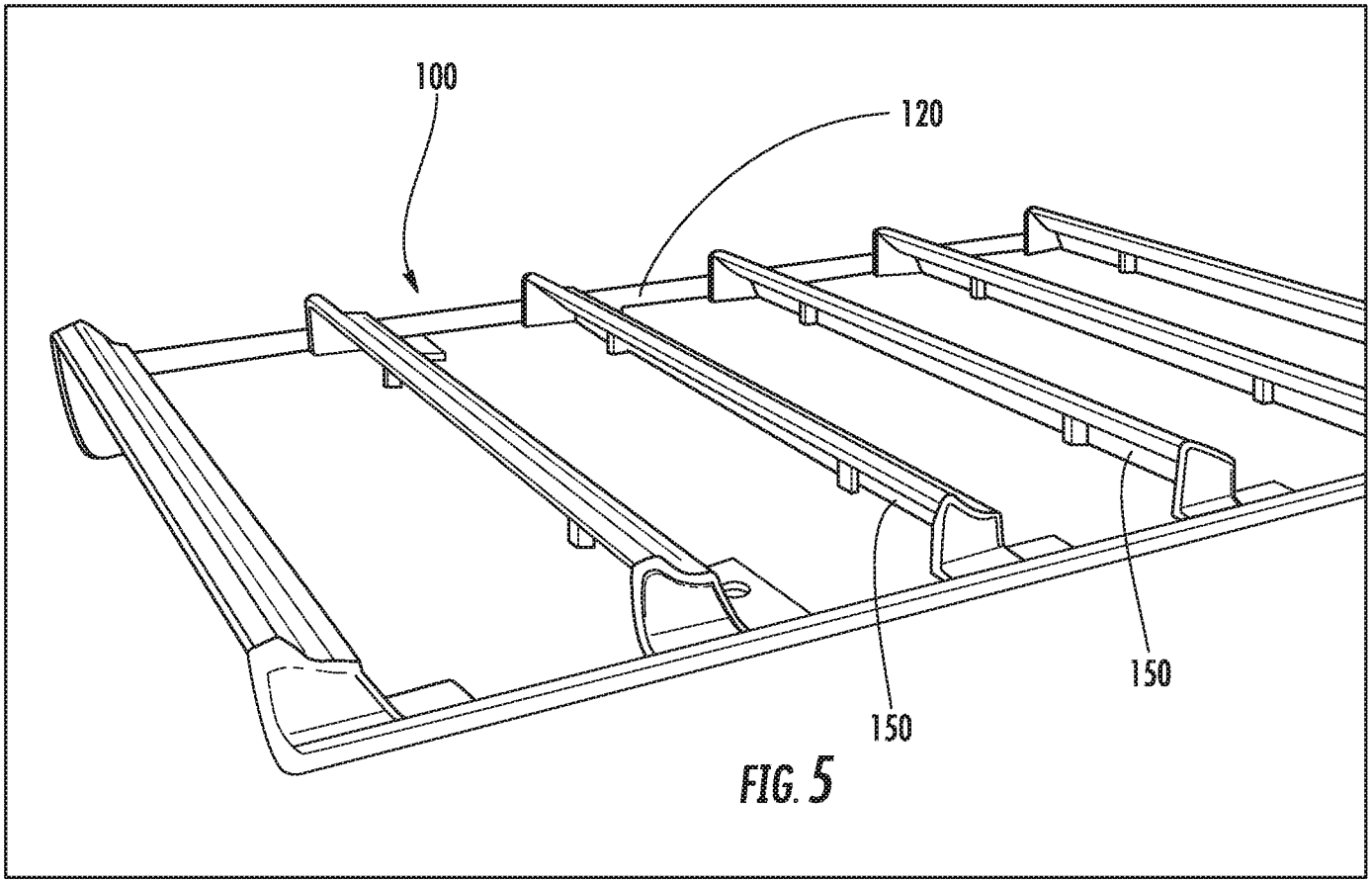
FIG. 5 is a top perspective view of the shield of FIG. 3.

It will be recognized that the shape of the shield and reflectivity of the shield surfaces 150 can be modified to provide a desired light profile. For example, if it is desired for the light to be directed from the light luminaire in an arc of 150 degrees (90 degrees forward and 60 degrees backward), the shape of the shield surface 150 can be modified to achieve this result and/or the opposite second side 140 of the shield surface 150 (i.e., the side facing away from the optic 310) could be fully or partially reflective so as to achieve the desired degree of backwards reflection of light. As a comparative example, the shield surface 150 illustrated in the side view of FIG. 4 is shorter and does not cover as much of the optic 310 as that of FIG. 6, which would increase the arc of light that would be directed from the luminaire.

As discussed above, the frame 120 is mountable to the LED luminaire 200 such that the shield 100 is removable therefrom. To that end, the frame 120 may include in some embodiments a plurality of apertures 160 for mounting the frame 120 on the LED luminaire 200. While shown in the figures as a hole for receiving a fastener such as a screw, it will be recognized that other types of apertures or fastening systems could be provided for mounting the shield 100 to the LED luminaire 200.

In some embodiments, the frame 120 of the shield 100 extends around the entire perimeter 210 of the surface 220 of the LED luminaire 200 such that each row 290 of LEDs 300 is covered by a respective row of shield surfaces 150. Such an embodiment, in which a plurality of rows 290 of LEDs 300 are covered by respective rows of shield surfaces 150, would be evident in the construction illustrated in, e.g., FIG. 2, when assembled.

Figure 8:
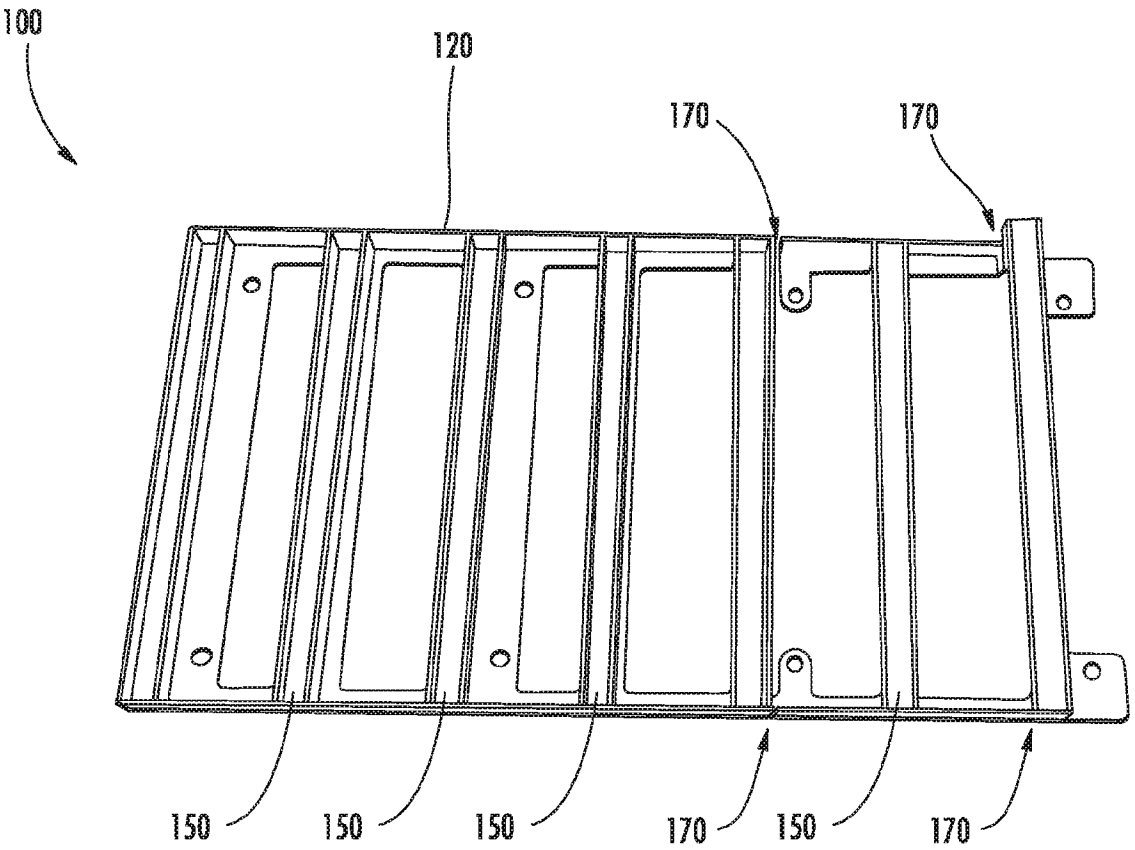
FIG. 8 is a top view of a shield according to another embodiment of the invention having notches for removal of a portion thereof.
Figure 9:
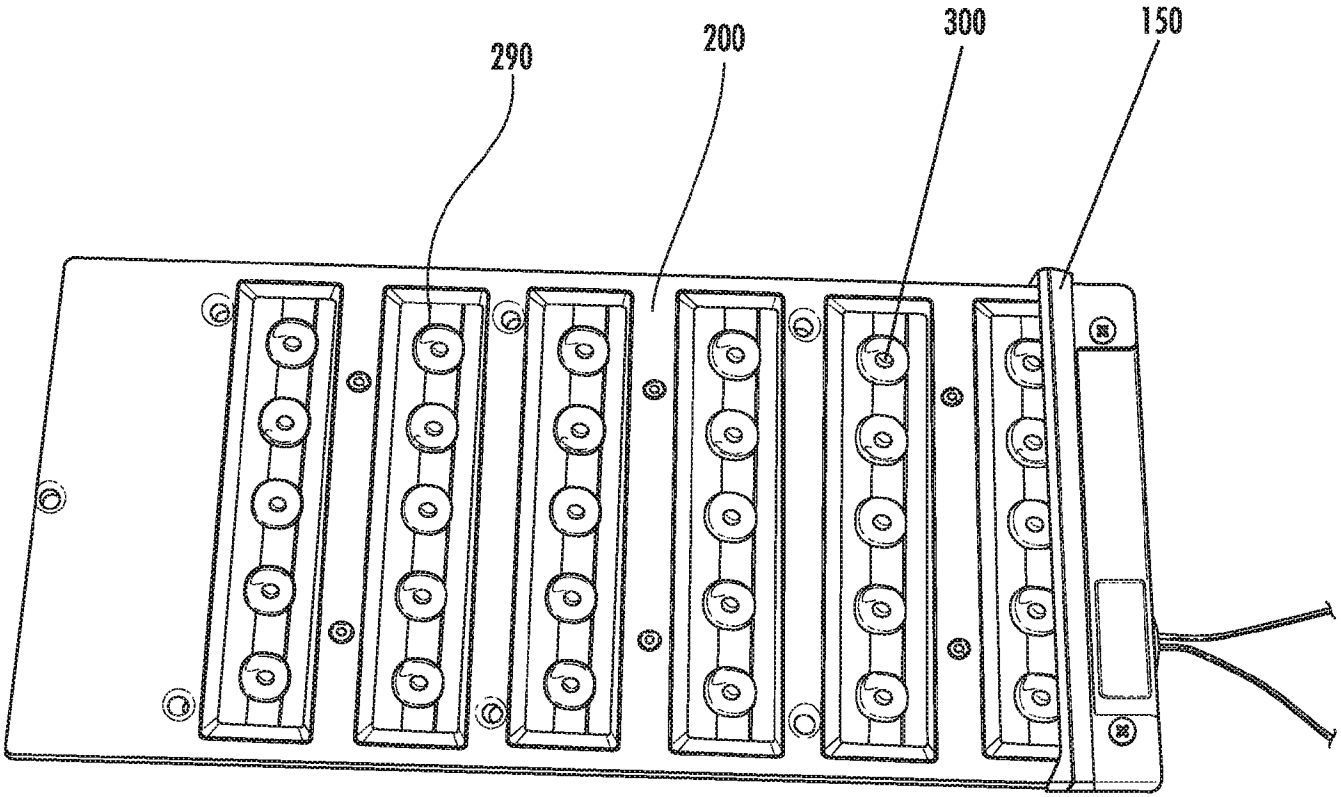
FIG. 9 is a bottom view of a LED luminaire having a portion of a shield attached thereto.

The separation of the shield 100 and LED luminaire 200 into separate components provides a customization benefit not available in previous luminaire constructions. For example, and with reference to FIG. 8, in certain embodiments of the invention, the frame 120 includes a plurality of notches 170 for allowing removal of one or more of the plurality of rows of shield surfaces 150 or a portion thereof from the frame 120 and for customization of light distribution from the LED luminaire. FIG. 9 shows an LED luminaire 200 having only one row of shield surface 150 located thereon. In such an embodiment, the frame 120 of the shield 100 is mounted on only a portion of the perimeter 210 such that only a portion of the rows 290 of LEDs 300 are covered by rows of shield surfaces 150.

Figure 10:
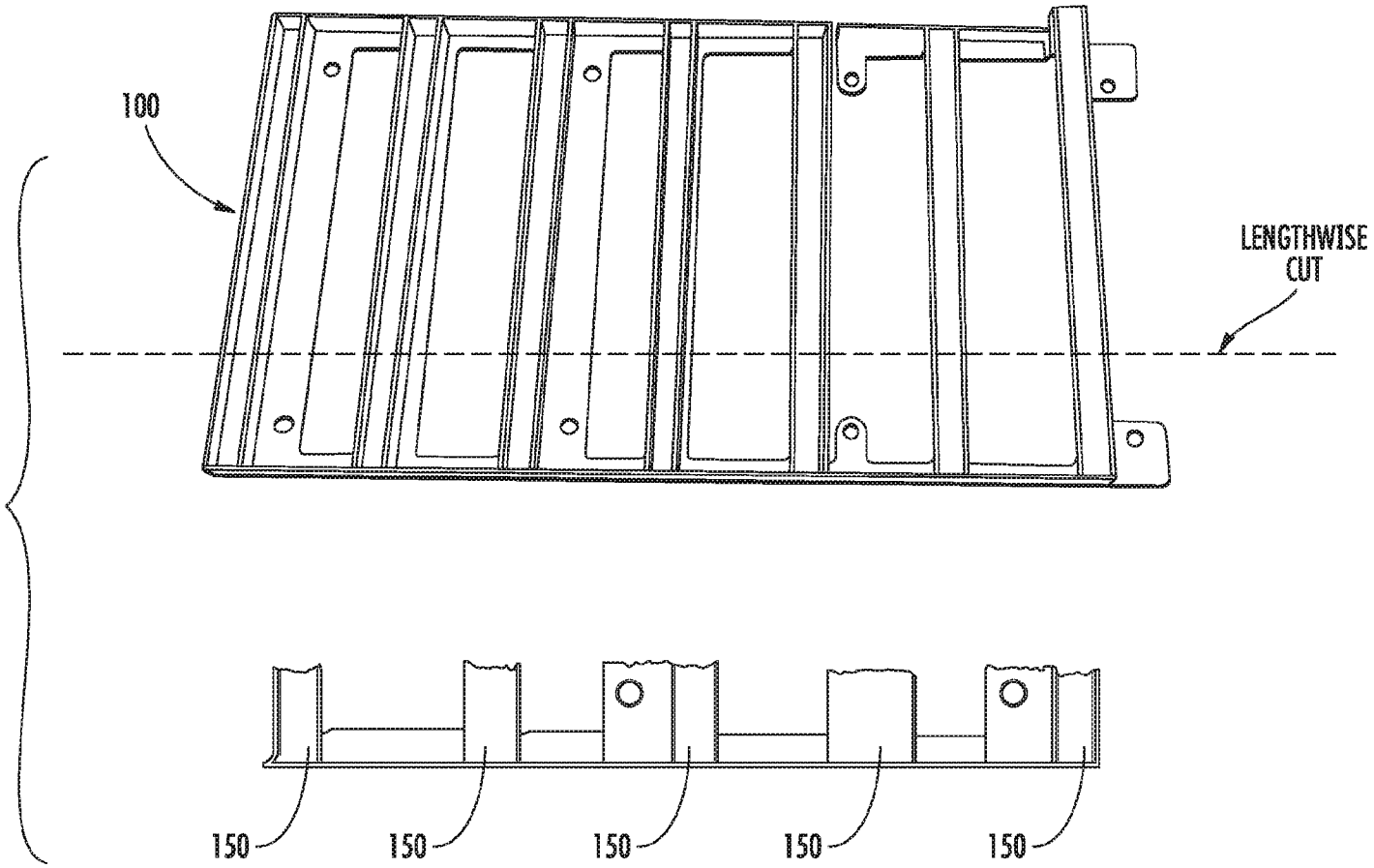
FIG. 10 is a top view of a shield according to another embodiment of an invention configured as a side light shield.
Figure 11:
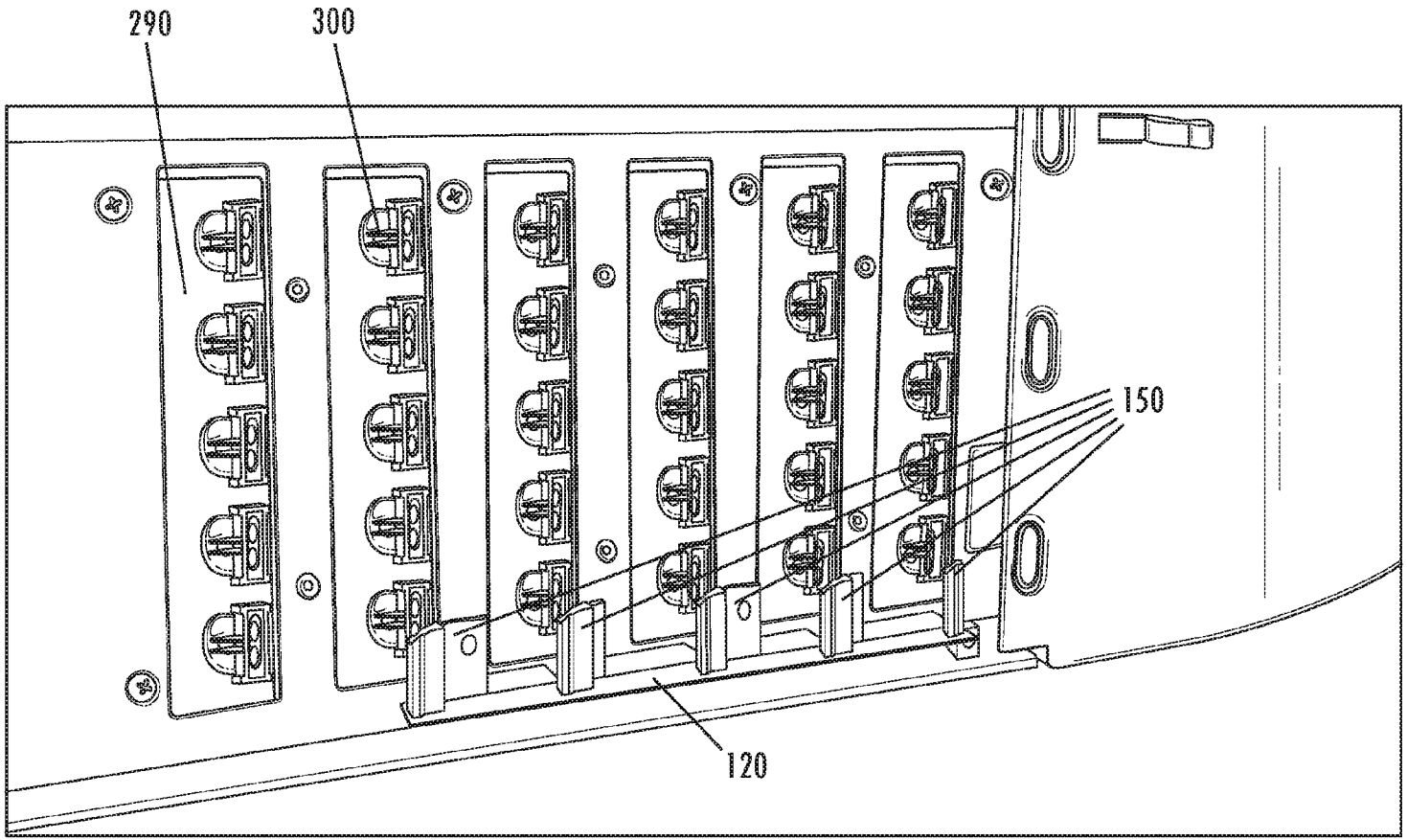
FIG. 11 is a bottom view of a LED luminaire having the side light shield of FIG. 10 installed thereon.

In further alternative embodiments, and with reference to FIGS. 10 and 11, the shield 100 may be cut lengthwise and installed on an LED luminaire 200 as a "side light shield" in which particular LEDs 300 are shielded but others are not. In such embodiments, some LEDs 300 in a particular row 290 of LEDs 300 are shielded by a partial shield surface 150 but other LEDs 300 in the row 290 are not shielded. Such embodiments may be useful where it is desired to shield light from being emitted in certain directions from the luminaire—for example the right side of the luminaire as shown in FIG. 11. In other embodiments (not shown), side light shields may be placed on both sides of the LED luminaire so that light from the LED luminaire 200 is primarily directed forward and backward but not to either side.

The shield 100 may be formed of known materials, including suitable polymers and metals. As explained above, the shield 100 may include a coating of reflective and/or diffuse/nonreflective materials or the shield itself may be formed from the reflective and/or diffuse/nonreflective material.

The invention thus provides emitted light from a LED luminaire to be directed in a desired direction. For example, a street light could be configured to direct all of the light towards the road instead of on the side of the road, improving the efficiency of the LED luminaire and reducing light "pollution" into areas that are not intended or desired to be lit.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A shield for a light emitting diode (LED) luminaire having a plurality of rows of LEDs that emit light, the shield having a top and a bottom and comprising:

a frame having opposing side edges separated by a distance, a first end, and a second end opposite the first end, wherein the frame is mountable to the LED luminaire such that the shield is removable from the LED luminaire;

a plurality of elongated shield members, wherein each of the plurality of elongated shield members:

extends the distance between the opposing side edges of the frame;

comprises a first side and a second side, wherein the first side comprises a reflective surface and faces the first end of the frame and wherein the second side faces the second end of the frame;

is configured to extend parallel and adjacent to one of the plurality of rows of LEDs located on the LED luminaire; and in cross section, comprises an arm including a first generally planar portion that extends upward from the plurality of rows of LEDs and a second portion which at least partially covers over and curves away from the one of the plurality of rows of LEDs so that the elongated shield member blocks light emitted by the one of the plurality of rows of LEDs toward the second end of the frame and so that the first side of the elongated shield member reflects the blocked light toward the first end of the frame; and a plurality of elongated openings extending entirely through the shield from the top to the bottom of the shield, each elongated opening extending the distance between the opposing side edges of the frame and adjacent to at least one of the plurality of elongated shield members, wherein at least one of the plurality of rows of LEDs resides in one of the plurality of elongated openings such that light emitted by the at least one of the plurality of rows of LEDs passes through the one of the plurality of elongated openings in which it resides.

2. The shield of claim 1, wherein the second side of each of the plurality of elongated shield members comprises a diffuse or nonreflective surface.

3. The shield of claim 1, wherein the second side of each of the plurality of elongated shield members comprises a reflective surface.

4. The shield of claim 1, wherein the reflective surface on the first side is coated onto the first side or is integrally formed in the first side.

5. The shield of claim 1, wherein the frame further comprises a plurality of notches for allowing removal of one or more of the plurality of elongated shield members or a portion thereof from the frame.

6. The shield of claim 1, wherein the plurality of rows of LEDs are located on the LED luminaire on a surface, the surface comprises a perimeter, and the frame of the shield extends around the entire perimeter of the surface such that the light emitted by each of the plurality of rows of LEDs engages one of the plurality of elongated shield members.

7. The shield of claim 1, wherein the plurality of rows of LEDs are located on the LED luminaire on a surface, the surface comprises a perimeter, and the frame of the shield extends around only a portion of the perimeter of the surface such that the light emitted by only some of the plurality of rows of LEDs engages one of the plurality of elongated shield members.

8. The shield of claim 1, wherein each elongated shield member comprises a length and wherein each elongated shield member comprises a constant cross sectional shape extending along the length.

9. A light emitting diode (LED) luminaire having a front and a rear, the LED luminaire comprising:

a plurality of rows of LEDs located on a surface of the LED luminaire, wherein each LED emits light and is covered by an optic and wherein the surface comprises a perimeter;

a shield comprising a top and a bottom and removably attached to the LED luminaire, the shield comprising:

a frame having opposing side edges separated by a distance, a first end, and a second end opposite the first end;

a plurality of elongated shield members, wherein each of the plurality of elongated shield members:

extends the distance between the opposing side edges of the frame;

comprises a first side and a second side, wherein the first side comprises a reflective surface and faces the front of the LED luminaire and wherein the second side faces the rear of the LED luminaire;

extends parallel and adjacent to one of the plurality of rows of LEDs located on the LED luminaire; and in cross section, comprises an arm including a first generally planar portion that extends upward from the plurality of rows of LEDs and a second portion which at least partially covers over and curves away from the one of the plurality of rows of LEDs so that the elongated shield member blocks light emitted by the one of the plurality of rows of LEDs toward the rear of the LED luminaire and so that the first side of the elongated shield member reflects the blocked light toward the front of the LED luminaire; and a plurality of elongated openings extending entirely through the shield from the top to the bottom of the shield, each elongated opening extending the distance between the opposing side edges of the frame and adjacent to at least one of the plurality of elongated shield members, wherein at least one of the plurality of rows of LEDs resides in one of the plurality of elongated openings such that light emitted by the at least one of the plurality of rows of LEDs passes through the one of the plurality of elongated openings in which it resides.

10. The LED luminaire of claim 9, wherein the second side of each of the plurality of elongated shield members has a diffuse or nonreflective surface.

11. The LED luminaire of claim 9, wherein the second side of each of the plurality of elongated shield members has a fully or partially reflective surface.

12. The LED luminaire of claim 9, wherein the reflective surface on the first side is coated onto the first side or is integrally formed in the first side.

13. The shield of claim 9, wherein each elongated shield member comprises a length and wherein each elongated shield member comprises a constant cross sectional shape extending along the length.

14. The shield of claim 9, wherein the frame of the shield extends around the entire perimeter of the surface such that the light emitted by each LED within each of the plurality of rows of LEDs engages an elongated shield member.

15. The shield of claim 9, wherein the frame of the shield extends around only a portion of the perimeter of the surface such that the light emitted by only some of the plurality of rows of LEDs engages an elongated shield member.

16. A light emitting diode luminaire having a front and a rear and comprising:

a plurality of rows of LEDs located on a surface of the LED luminaire, wherein each LED emits light and is covered by an optic and wherein the surface comprises a perimeter;

a shield comprising a top and a bottom and removably attached to the LED luminaire, the shield comprising:

a frame having a side edge:

a plurality of shield members extending from the side edge of the frame, wherein each of the plurality of shield members:

comprises a first side and a second side, wherein the first side comprises a reflective surface and faces the front of the LED luminaire and wherein the second side faces the rear of the LED luminaire;

extends parallel and adjacent to one of the plurality of rows of LEDs located on the LED luminaire; and in cross section, comprises an arm including a first generally planar portion that extends upward from the plurality of rows of LEDs and a second portion which at least partially covers over and curves away from the one of the plurality of rows of LEDs so that the shield member blocks light emitted by at least some of the LEDs within the one of the plurality of rows of LEDs toward the rear of the LED luminaire and so that the first side of the shield member reflects the blocked light toward the front of the LED luminaire; and a plurality of openings located between adjacent shield members and extending entirely through the shield from the top to the bottom of the shield, wherein a plurality of the LEDs within one of the plurality of rows of LEDs reside within one of the plurality of openings such that light emitted by the plurality of the LEDs passes through the one of the plurality of openings in which it resides, wherein the frame of the shield extends around only a portion of the perimeter of the surface such that the light emitted from only some of the LEDs within each of the plurality of rows of LEDs engages an elongated shield member.

* * * * *